US009516951B2

(12) United States Patent
Rustemeyer

(10) Patent No.: US 9,516,951 B2
(45) Date of Patent: Dec. 13, 2016

(54) ANATOMY CONFORMED SUPPORT PILLOW

(71) Applicant: Billow Global, Inc., New York, NY (US)

(72) Inventor: Marnie Rustemeyer, New York, NY (US)

( * ) Notice: Subject to any disclaimer, the term of this patent is extended or adjusted under 35 U.S.C. 154(b) by 0 days.

(21) Appl. No.: 14/604,591

(22) Filed: Jan. 23, 2015

(65) Prior Publication Data

US 2016/0213158 A1 Jul. 28, 2016

(51) Int. Cl.
*A47C 20/02* (2006.01)
*A47D 13/08* (2006.01)

(52) U.S. Cl.
CPC ..... *A47C 20/026* (2013.01); *A47C 20/02* (2013.01); *A47C 20/027* (2013.01); *A47D 13/083* (2013.01)

(58) Field of Classification Search
CPC ..... A47D 13/083; A47D 15/00; A47G 9/109; A47G 9/10; A47G 9/1063; A47G 9/1054; A47C 20/026; A47C 20/025; A47C 20/02; A47C 20/00; A47C 20/027; A61G 7/05723; A61G 7/07
See application file for complete search history.

(56) References Cited

U.S. PATENT DOCUMENTS 3,382,510 A * 5/1968 Robinson ..... A47C 20/026 5/632
4,788,728 A * 12/1988 Lake ..... A47G 9/10 5/490
5,652,981 A * 8/1997 Singer-Leyton ..... A47C 20/026 5/631
6,052,847 A * 4/2000 Allyn ..... A47C 20/027 5/632
6,081,948 A 7/2000 Copeland
7,152,263 B1 * 12/2006 Delfs ..... A47G 9/10 5/636
7,426,762 B2 9/2008 Dazzi
2006/0101579 A1 * 5/2006 Albers ..... A47D 13/083 5/655
2008/0307580 A1 * 12/2008 Spitzer ..... A47C 20/026 5/636
2009/0094752 A1 4/2009 Gagliano et al.
2010/0205744 A1 * 8/2010 Edwards ..... A47C 7/383 5/644
2011/0083278 A1 * 4/2011 Muratalla ..... A47C 20/026 5/655.9
2011/0277243 A1 * 11/2011 Crompton ..... A47C 20/026 5/632
2012/0186022 A1 * 7/2012 Navarro ..... A47G 9/10 5/644
2013/0198961 A1 * 8/2013 Davis ..... A47C 7/62 5/648

* cited by examiner

*Primary Examiner* — Nicholas Polito
*Assistant Examiner* — Amanda L Miller
(74) *Attorney, Agent, or Firm* — Dinsmore & Shohl LLP; Monika L'Orsa Jaensson, Esq.

(57) ABSTRACT

An anatomical pillow configured for use by a woman includes a compressible body having an upper surface, lower surface, a top, a first side, a second side, a bottom, and a central recess. The relative dimensions and geometries of the segments and surfaces are selected to accommodate a woman lying prone on the pillow with her head above the upper surface and her torso lying on the bottom segment.

16 Claims, 4 Drawing Sheets

ANATOMY CONFORMED SUPPORT PILLOW

BACKGROUND OF THE INVENTION

1. Field of the Invention

The present invention relates generally to pillow's constructed for an anatomical support and, more particularly, to pillow's configured to support a women's anatomy.

The use of pillow's for supporting a person's head or torso while sleeping, resting, reading or any one of the variety of activities dates back to before recorded history. In recent times, a variety of specific pillow designs have been developed for particular purposes. Of particular interest to the present invention, pillows have been designed specifically for supporting a women's anatomy, and particularly for supporting a women's torso and head while the woman lies prone on a bed. While many of such pillow designs have incorporated a central void or cut-out region to accommodate the women's breasts, such designs have often not adequately accommodated the women's torso, arms, or proper head positioning.

For these reasons, it would be desirable to provide improved pillow designs and structures for accommodating a woman when lying prone on a bed or other surface. In particular, such pillow designs and structures should comfortably accommodate the women's breast, but also accommodate the woman's torso, arms, heads, and allow for stable support of the woman's body during use. While such pillows designs may be particularly intended for supporting a prone body, they will preferably also be suitable for use when a woman is in other positions and for other users and other purposes. At least some of these objectives will be met by the pillow designs and structures described herein below.

2. Description of the Background Art

Pillow designs intended for supporting a woman's anatomy are described in the following: U.S. Pat. Nos. 6,081,948 and 7,426,762; and U.S. Patent Publication Nos. 2008/0307580 and 2009/0094752.

SUMMARY OF THE INVENTION

In the first aspect of the present invention, a pillow comprises a compressible body configured for a woman's anatomy. The compressible body includes an upper surface, a lower surface, a top, a first side, a second side, a bottom, and a central recess. The compressible body may be generally formed as any conventional pillow, typically having an outer fabric or other shell filled with a compressible filling material. The filling material can be a latex or other rubber, goose or duck down, or more typically a natural fiber filling material. Presently preferred is a natural wool fiber fill. The other shell may similarly be formed from a conventional material, typically being a woven fabric, most typically being a woven cotton. Other shell materials, however, such as synthetic woven fibers, synthetic films, other natural fiber weaves, and the like, could also find use.

The present invention is characterized by a geometry which is uniquely suited for a woman's anatomy, particularly when the woman is lying prone on the pillow with her breasts received in the central recess of the compressible body. The pillow design is characterized by a top segment which extends upwardly from the central recess to the top of the pillow. The top segment has an indentation along its top edge, where the indentation is configured to accommodate the woman's head and chin while her breasts are received in the central recess. Thus, in typical use, the woman's head will extend over the top edge of the pillow and will not be supported by the pillow. Use of the pillow, of course, is not limited to this position, but the pillow design is particularly configured to accommodate such position.

The compressible body also includes a bottom segment which extends downwardly from the central recess to the bottom of the pillow. The bottom segment has a length in a downward direction which is at least three-fold greater than the length of the top segment in an upward direction. Thus, the pillow is particularly adapted to support the woman's upper body from the top segment of the compressible body and to support the woman's torso on the bottom segment of the compressible body.

In preferred aspects, the central recess will have a top edge (which lies at the bottom edge of the top segment) with a protrusion mid-center which has a similar geometry to that of the indentation in the top segment of the compressible body. The protrusion helps support the woman's chest between the breasts and helps define a semi-circular left side and a semi-circular right side of the central recess. The semi-circular configurations are particularly configured to receive the woman's left and right breasts, respectively. In still further preferred embodiments, the compressible body is further divided into a right side segment extending to the right of the central recess and a left side segment extending to the left of the central recess. The side segments are configured particularly to support the woman's shoulders as she lies prone on the pillow.

In specific embodiments, each of the four segments of the compressible body is separated from the adjacent segments by a seam that prevents filling from moving from one side to another. Typically, the seams will further define valleys or depressions in the upper and lower surfaces of the compressible body where the depressions or valleys help the pillow accommodate the woman's anatomy and allow the pillow to more readily conform and adjust to movements of the body during use.

In specific embodiments, the seams separating the segments are located along lines positioned at 1 o'clock, 4 o'clock, 8 o'clock, and 11 o'clock when the upward direction of the compressible body is at 12 o'clock. Such specific designs will usually have a heart-shaped periphery for the bottom segment has a semi-circular bottom periphery.

Usually, the recess will not be filled or will have minimal filling so that its thickness is much less than any of the segments surrounding the recess. In some instances, it may be possible to have the recess cut out from the compressible body, but more usually the recess will be occupied by the shell or cover material or other similar membrane, netting, or other structure to help support the breasts when they are received in the recess.

In further aspects of the invention, the different segments of the pillow will have different thicknesses. Usually, the top segment will be the least thick, typically having a thickness in the range from 0.5 inch to 2 inches. The side segments will have a greater thickness than the top segment, typically being arranged from 2 inches to 4 inches, and the bottom segment will have the greatest thickness, typically being in the range from 6 inches to 8 inches.

Overall, the pillow will have dimensions intended to accommodate a woman's anterior upper torso. Typically, the length from top to bottom of the compressible body will be the range from 24 inches to 32 inches and the width across the side segments will be in the range from 22 inches to 30 inches.

INCORPORATION BY REFERENCE

All publications, patents, and patent applications mentioned in this specification are herein incorporated by reference to the same extent as if each individual publication, patent, or patent application was specifically and individually indicated to be incorporated by reference.

BRIEF DESCRIPTION OF THE DRAWINGS

The novel features of the invention are set forth with particularity in the appended claims. A better understanding of the features and advantages of the present invention will be obtained by reference to the following detailed description that sets forth illustrative embodiments, in which the principles of the invention are utilized, and the accompanying drawings of which:

DETAILED DESCRIPTION OF THE INVENTION

Figure 1:
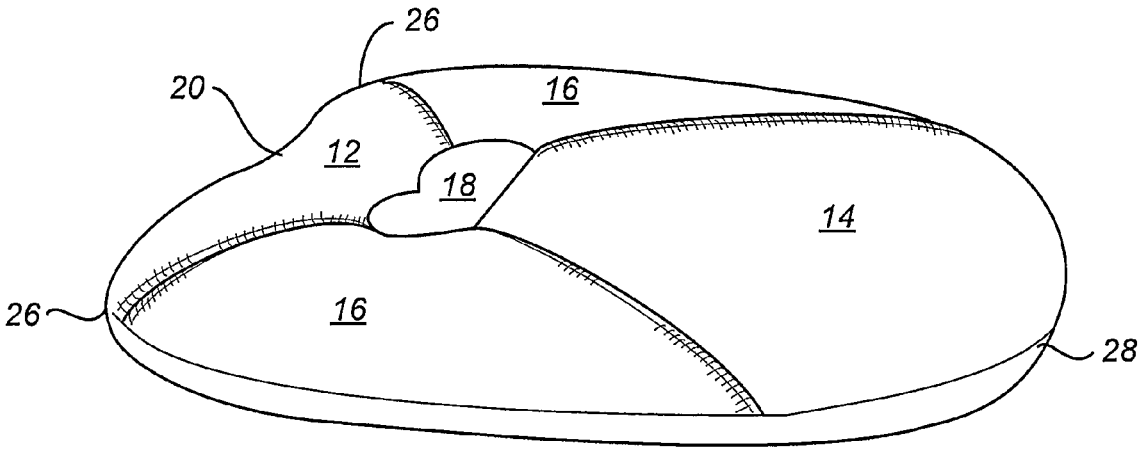
FIG. 1 is a perspective view of an anatomical support pillow constructed in accordance with the principles of the present invention.

Referring to FIGS. 1 and 3-5, an exemplary anatomical pillow 10 constructed in accordance with the principles of the present invention includes a top segment 12, a bottom segment 14, right and left side segments 16, and a central recess 18. An indentation 20 is formed along an upper edge of the top segment 12 and lies between shoulder portions 26 which provide the top most edges of the pillow. The central recess 18 typically has a protrusion 22 which extends into the recess and which defines semi-circular regions 24 on the right and left sides of a center line of the pillow. The segments are defined by seams 30 which are typically sewn or otherwise formed into a cover of the pillow in order to contain a filling material in each segment. The seams typically define depressions or valleys in the upper and lower surfaces of the pillow which will provide hinge-like regions which help the pillow bend and conform to the anatomy during use. In the specifically illustrated embodiment, the bottom segment will have a semi-circular edge, and the combination of indentation 20, upper shoulders 26, and lower semi-circular edge will together define a heart-shaped pillow geometry.

Figure 2:
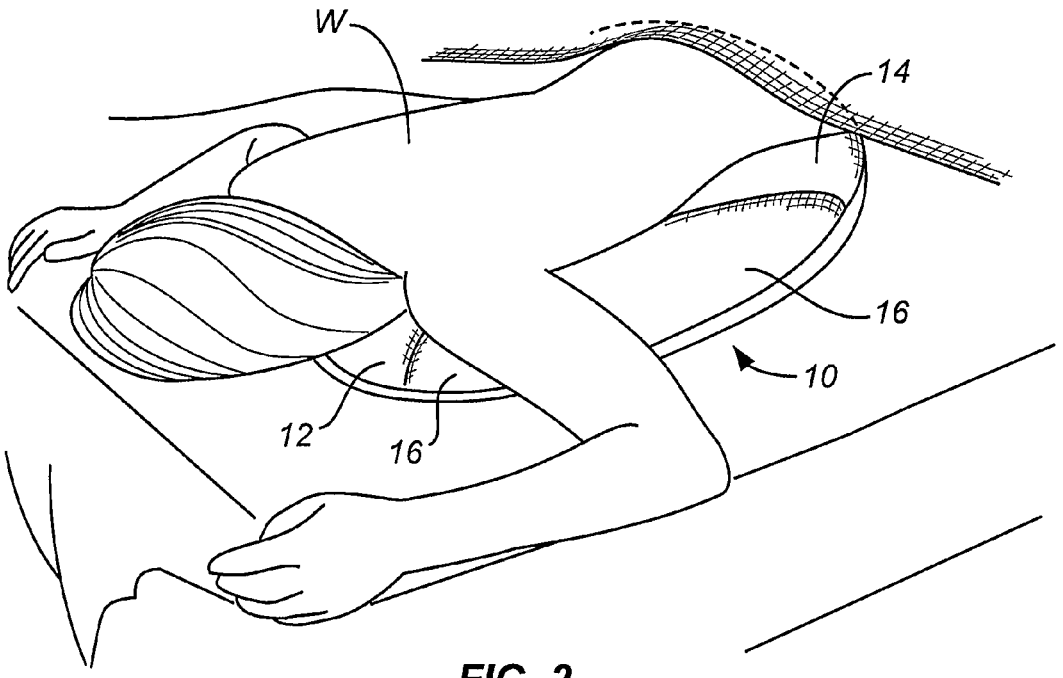
FIG. 2 illustrates a woman in a prone position using the anatomical support pillow of FIG. 1.
Figure 3:
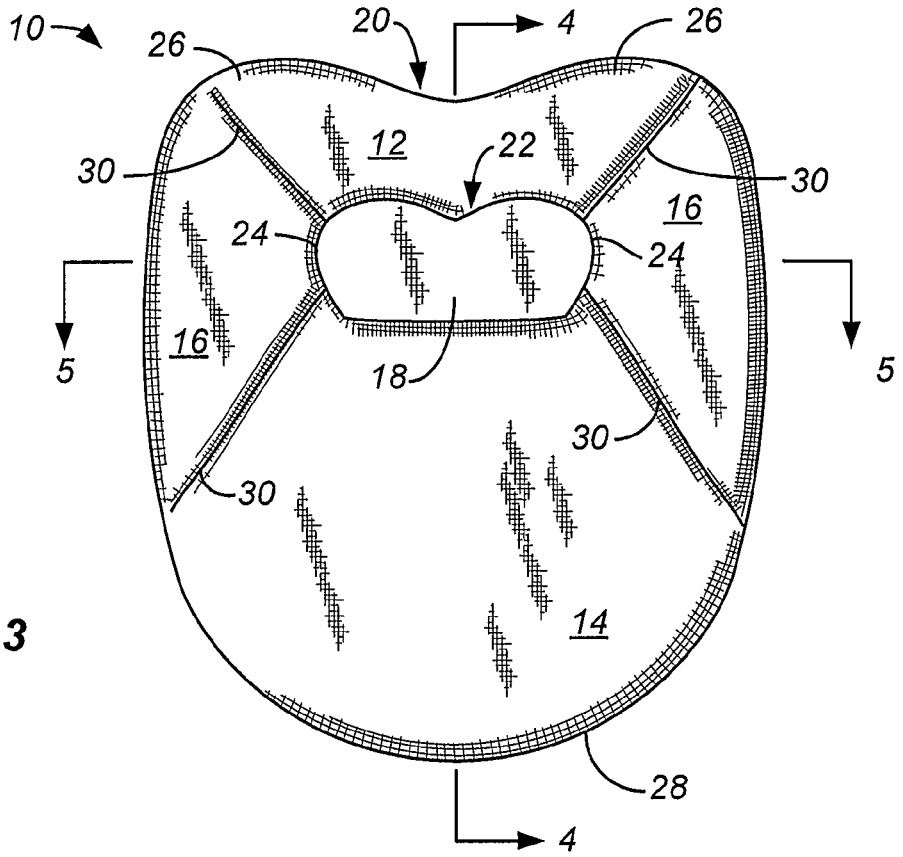
FIG. 3 is a top, plan view of the anatomical support pillow of FIG. 1.

As shown in FIG. 2, an exemplary use of the pillow is for a woman W to lie prone and face downward on the pillow with her breasts received within the central receptacle 18 and her head lying above an upper edge of the pillow with her chin and face generally received in the indentation 20 of the top segment 12 of the pillow. The shoulders 26 of the pillow extend upwardly to help support or cradle the head, and the woman's arms can extend outwardly over the side segments 16, with the arms upward as illustrated or in other positions, such as folded inwardly, downwardly, and the like. The woman's torso beneath the breasts will be supported on the bottom segment 14 of the pillow.

Figure 4:
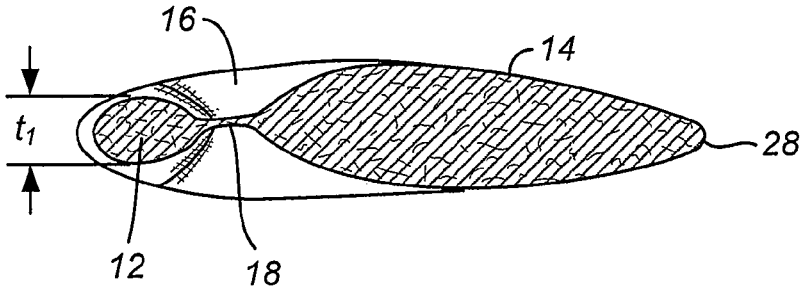
FIG. 4 is a cross-sectional view taken along line 4-4 of FIG. 3.
Figure 5:
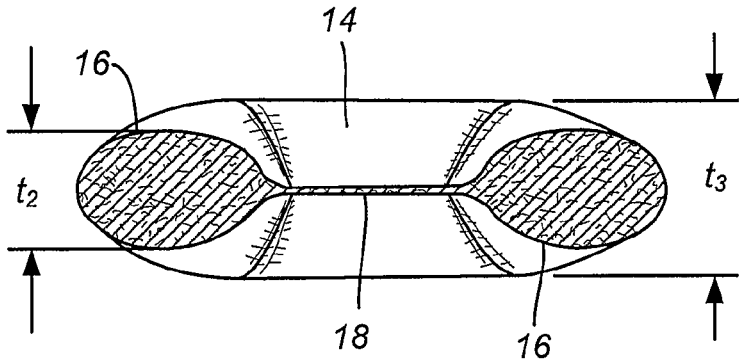
FIG. 5 is a cross-sectional view taken along line 5-5 of FIG. 3.

In preferred embodiments, as illustrated in FIGS. 4 and 5, the upper segment 12 will have a thickness $t_1$ which is less than a thickness $t_2$ of the side segment 16, which in turn is less than the thickness $t_3$ of the bottom segment. Such a variation in the segment thicknesses has been found to provide particular comfort and support for a woman's anatomy. Preferred dimensions are provided in Table 1 below.

TABLE 1

| Pillow Dimensions | |
|---|---|
| Dimension | Range |
| a | 24 inches-32 inches |
| b | 22 inches-30 inches |
| c | 5 inches-7 inches |
| d | 2 inches-3 inches |
| e | 18 inches-22 inches |
| f | 10 inches-14 inches |
| g | 8 inches-10 inches |
| h | 6 inches-10 inches |
| i | 9 inches-13 inches |
| $t_1$ | 0.5 inch-2 inches |
| $t_2$ | 2 inches-4 inches |
| $t_3$ | 6 inches-8 inches |

Figure 6:
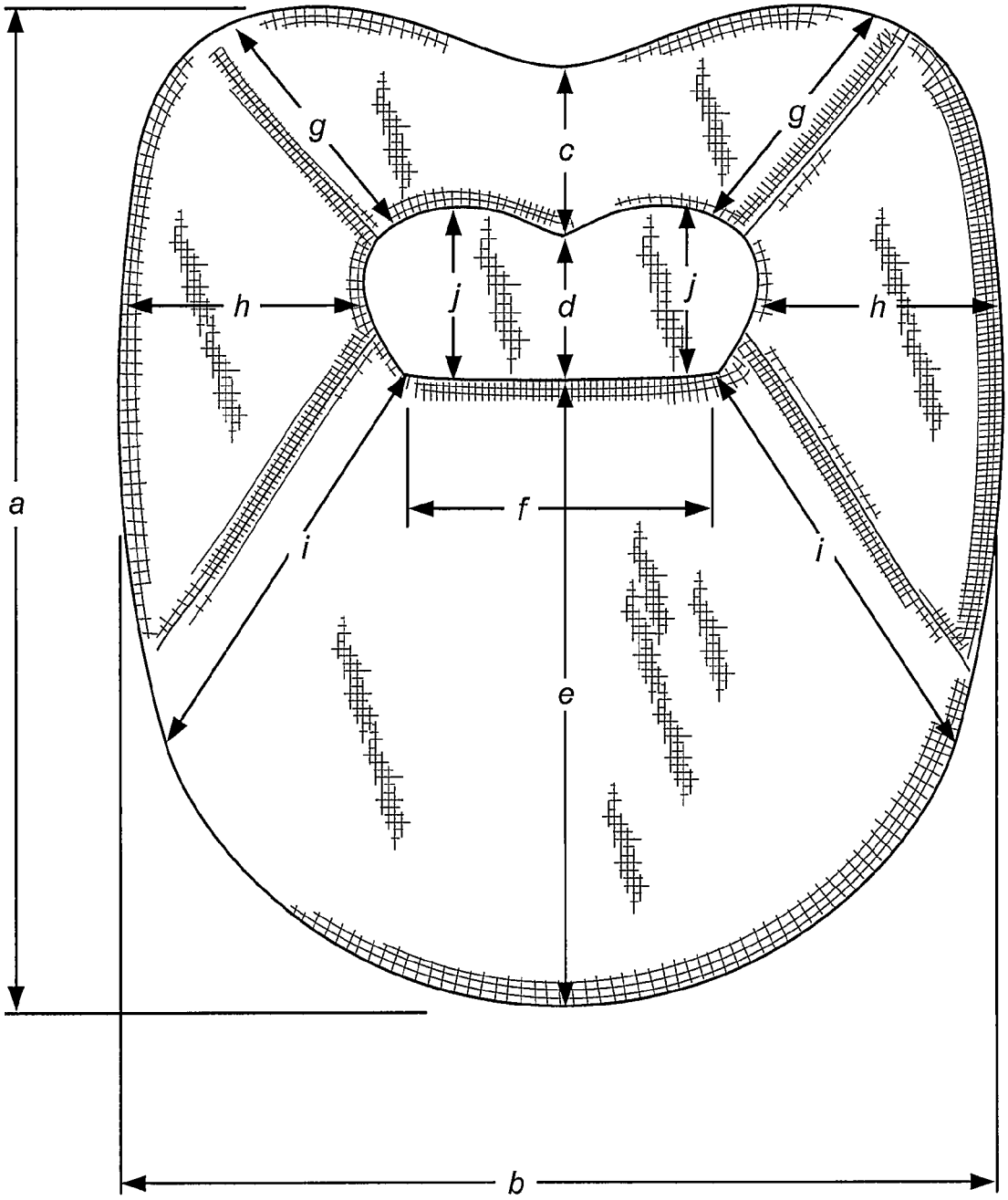
FIG. 6 is a top view similar to FIG. 3, showing preferred dimensional ranges of the different segments of the pillow.

Other preferred dimensions of the pillow 10 are provided in FIG. 6 with reference to Table 1 above.

Figure 7:
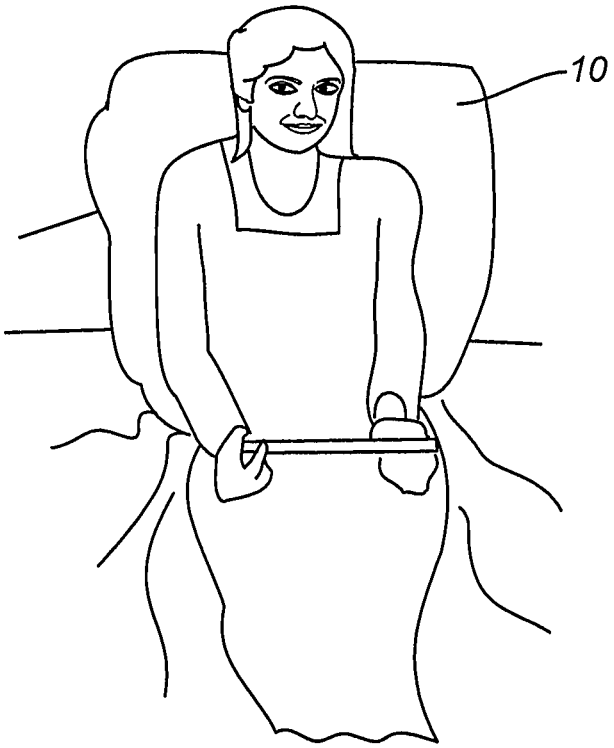
FIGS. 7 and 8 illustrate other uses for the pillows of the present invention.
Figure 8:
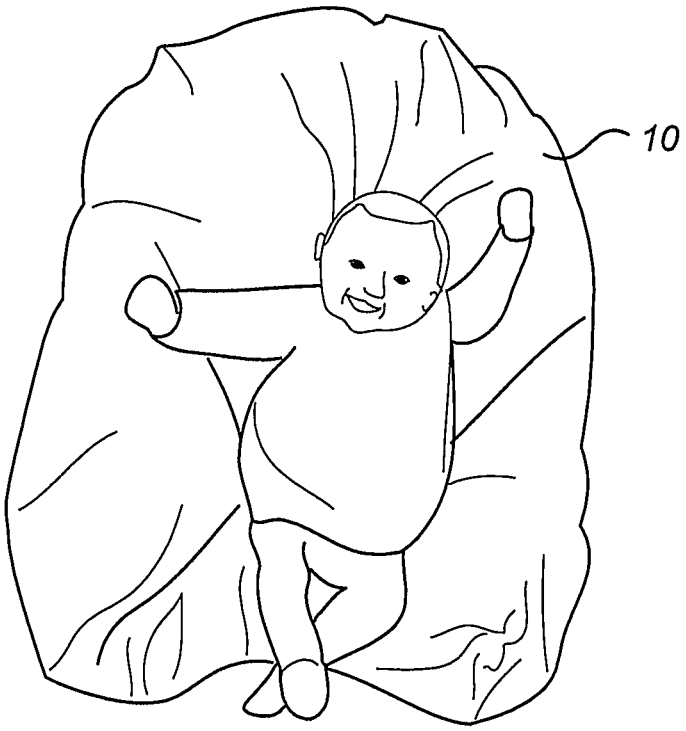

While the described pillow is particularly intended for a use by a woman lying in a prone position with her head above the top of the pillow, the pillow can find many other uses such as illustrated in FIG. 7 where anyone can use the pillow as back support and as illustrated in FIG. 8 where an infant is comfortably accommodated lying in a prone or supine position on the pillow.

While preferred embodiments of the present invention have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein may be employed in practicing the invention. It is intended that the following claims define the scope of the invention and that methods and structures within the scope of these claims and their equivalents be covered thereby.

What is claimed is:

1. A pillow configured for a women's anatomy, said pillow comprising: a compressible body having an upper surface, a lower surface, a top, a first side, a second side, a bottom, and a central recess;

wherein a top segment of the compressible body extends upwardly from the central recess to the top and has an indentation along a top edge thereof configured to accommodate a woman's chin when the woman's breasts are received in the central recess;

wherein the central recess has a linear bottom edge and a central recess top edge having a protrusion axially aligned with and extending into the central recess in the same direction as the indentation in the too of the compressible body;

wherein a bottom segment of the compressible body extends downwardly from the central recess to the bottom and has a length in a downward direction which is greater by a factor of at least three than a length of the top segment in an upward direction from the central recess; and wherein the compressible body is further divided into a right side segment extending rightward of the central recess and a left side segment extending to leftward of the central recess, wherein each segment is separated from two adjacent segments by seams radiating from the central recess, the seams defining depressions in the upper and lower surfaces of the pillow to provide hinge-like regions configured to help the pillow bend and conform to an anatomy of a woman during use.

2. A pillow as in claim 1, where the recess has a top edge having a protrusion is axially aligned with and in the same direction as the indentation in the top of the compressible body.

3. A pillow as in claim 1, wherein the central recess has a semi-circular left side and a semi-circular right side which are configured to receive a woman's left and right breasts, respectively.

4. A pillow as in claim 1, wherein a periphery of the pillow is heart-shaped.

5. A pillow as in claim 4, wherein the bottom segment has a semi-circular bottom periphery.

6. A pillow as in claim 1, wherein the top segment, the bottom segment, and both side segments are formed from a shell material filled with a filling material.

7. A pillow as in claim 6, wherein the filling material comprises natural fiber, down, or a synthetic material.

8. A pillow as in claim 7, wherein the filling material comprises wool.

9. A pillow as in claim 6, wherein the central recess is not filled with a filling material.

10. A pillow as in claim 6, wherein the shell material comprises a natural fiber or a synthetic material.

11. A pillow as in claim 10, wherein the shell material comprises cotton.

12. A pillow as in claim 1, wherein the top segment has a maximum, uncompressed thickness, wherein the side segments each have a maximum, uncompressed thickness which is greater than that of the top segment, and wherein the bottom segment has a maximum, uncompressed thickness which is greater than that of the side segments.

13. A pillow as in claim 12, wherein the pillow has a total length from top to bottom in a range from 24 inches to 32 inches, a width across the side segments in a range from 22 inches to 30 inches.

14. A pillow as in claim 13, wherein the top segment has a thickness in a range from 0.5 inch to 2 inches, wherein the side segments have a thickness in a range from 2 inches to 4 inches, and wherein the bottom segment has a thickness in a range from 6 inches to 8 inches.

15. A pillow as in claim 3, wherein the semi-circular left side and the semi-circular right side are non-concentric.

16. A pillow as in claim 1, wherein the central recess is oblong.

* * * * *